US012018477B2

(12) United States Patent
Savkay

(10) Patent No.: US 12,018,477 B2
(45) Date of Patent: Jun. 25, 2024

(54) STRUCTURE SYSTEM AND A PRODUCTION METHOD THEREOF

(71) Applicant: Berkay Hakki Savkay, Beykoz/Istanbul (AR)

(72) Inventor: Berkay Hakki Savkay, Beykoz/Istanbul (AR)

( * ) Notice: Subject to any disclaimer, the term of this patent is extended or adjusted under 35 U.S.C. 154(b) by 177 days.

(21) Appl. No.: 17/780,410

(22) PCT Filed: Nov. 3, 2020

(86) PCT No.: PCT/TR2020/051028
§ 371 (c)(1),
(2) Date: May 26, 2022

(87) PCT Pub. No.: WO2021/112791
PCT Pub. Date: Jun. 10, 2021

(65) Prior Publication Data

US 2022/0412076 A1 Dec. 29, 2022

(30) Foreign Application Priority Data

Dec. 6, 2019 (TR) ..... 2019/19489

(51) Int. Cl.
*E04B 1/76* (2006.01)
*E04B 1/88* (2006.01)

(52) U.S. Cl.
CPC ..... *E04B 1/7604* (2013.01); *E04B 1/88* (2013.01)

(58) Field of Classification Search
CPC ..... E04B 1/7604; E04B 1/7608; E04B 2001/7679; E04B 1/88; E04B 2/86; E04C 2/288
See application file for complete search history.

(56) References Cited

U.S. PATENT DOCUMENTS 2,934,934 A 5/1960 Berliner
3,336,710 A * 8/1967 Raynes ..... E04C 2/288 428/44

(Continued)

FOREIGN PATENT DOCUMENTS

CN 203856099 U 10/2014
EP 2221425 A1 8/2010

OTHER PUBLICATIONS

International Search Report for corresponding PCT application No. PCT/TR2020/051028, mailed Mar. 8, 2021.

(Continued)

*Primary Examiner* — Patrick J Maestri
(74) *Attorney, Agent, or Firm* — Notaro, Michalos & Zaccaria P.C.

(57) ABSTRACT

A structure system that enables heat, sound and moisture insulation without having a thermal bridge and has its own load-bearing elements, and a production method is disclosed. The structure system has at least one main load-bearing system, and at least one filling material that partially or completely surrounds the main load-bearing system and has an insulating feature. The production method of the structure system has the steps of placing the main loadbearing system in at least one mould in a way that there is a space between the main load-bearing system and the surfaces of the mould, wherein the filling material does not adhere to the mould and the mould limits the filling material so as to shape it, filling and drying the filling material in the space so as to partially or completely surround the main load-bearing system, and removing the mould after the drying process is completed.

4 Claims, 4 Drawing Sheets

(56) References Cited

U.S. PATENT DOCUMENTS

| | | | | |
|---|---|---|---|---|
| 3,775,240 | A | 11/1973 | Harvey | |
| 4,805,366 | A * | 2/1989 | Long | E04C 2/288 249/40 |
| 4,823,534 | A * | 4/1989 | Hebinck | E04D 13/17 52/251 |
| 4,865,894 | A * | 9/1989 | Shubow | E04C 1/41 428/59 |
| 2004/0065034 | A1* | 4/2004 | Messenger | E04C 2/2885 52/309.11 |
| 2007/0033890 | A1 | 2/2007 | Solomon | |
| 2008/0250740 | A1 | 10/2008 | Miller | |
| 2012/0137610 | A1 | 6/2012 | Knight | |
| 2021/0108412 | A1* | 4/2021 | Heath | E04C 2/049 |
| 2021/0301527 | A1* | 9/2021 | Dombowsky | B28B 19/0015 |

OTHER PUBLICATIONS

Written Opinion of Interational Preliminary Authority for corresponding PCT application No. PCT/TR2020/051028, mailed Nov. 11, 2021.

International Preliminary Report on Patentability for corresponding PCT application No. PCT/TR2020/051028, completed Jan. 21, 2022.

* cited by examiner

STRUCTURE SYSTEM AND A PRODUCTION METHOD THEREOF

TECHNICAL FIELD

The present invention relates to a structure system which enables heat, sound and moisture insulation without having a thermal bridge, has its own load-bearing elements and preferably has a mono-block modular form, and to a production method thereof.

BACKGROUND OF THE INVENTION

Currently, load-bearing systems of building structures are defined as conventional load-bearing systems consisting of masonry blocks, bars, plates and combinations thereof according to geometric properties and load-bearing methods of the structural components of the system. Insulation of structures constructed with the aforementioned conventional load-bearing systems is provided by insulation materials providing heat, sound and moisture insulation and mounted externally on said structures by various methods, as well as by modifying the structure of load-bearing material (especially the concrete material). However, the insulation material does not make any contribution to the load-bearing elements, which form the structure, in terms of load-bearing. In addition, there may be a change in physical properties of the materials which are modified to provide insulation characteristics to the structures obtained by said methods, and in particular, their strength may decrease. For example, in order to provide reinforced concrete building elements with insulation, heat insulation can be obtained by some materials (such as expanded perlite) which are added to the cement-based concrete mixture as aggregate. However, the strength is considerably decreased in the structures constructed with this method. Moreover, with said method, porosity occurs in the material and additional material application is required for moisture insulation since porosity substantially increases the water absorption, in which case material and labour costs are increased and excessive time is spent for the construction phase.

In building structures, load-bearing plates which are made of steel reinforcements placed in aerated concrete are also used. However, disadvantages of the above-mentioned method are not eliminated in the aerated concrete structures, and both structural and insulation discontinuity points occur due to the serial connection details of external insulations. This causes insulation requirements such as additional moisture insulation and heat insulation.

After the construction process in the above-mentioned structure systems is completed, additional insulation layers with different physical properties are applied on a section or the structure, as in conventional insulation methods. However, this also increases material and labour costs and causes loss of time.

In addition, in off-site construction projects, lack of manufacturing at the final regions where living modules (prefinished-prefabricated volumetric constructions (PPVC)) or these structures will be deployed ensures that prefabrication is considered successful. However, constructions made with said conventional methods cannot fully meet this requirement.

BRIEF DESCRIPTION OF THE INVENTION

The present invention relates to a structure system which enables heat, sound and moisture insulation without having a thermal bridge and has its own load-bearing elements, and to a production method thereof. The structure system comprises at least one main load-bearing system; and at least one filling material which partially or completely surrounds the main load-bearing system and has an insulating feature. The production method of the structure system, on the other hand, comprises the steps of: placing the main load-bearing system in at least one mould in such a way that there is a space between the main load-bearing system and the surfaces of the mould, wherein the filling material does not adhere to the mould and the mould limits the filling material so as to shape it; filling and drying the filling material in said space so as to partially or completely surround the main load-bearing system; and removing the mould after the drying process is completed. Here, after the mould is removed, the main load-bearing system and the filling material which surrounds the main load-bearing system are obtained as the final product. With said method, a mono-block modular structure is achieved. In addition, integration of the filling material by surrounding the main load-bearing system contributes to the load-bearing property and rigidity of the structure system, and at the same time, a design without a thermal bridge is allowed. Further, the main load-bearing system is in the form of a bar and comprises at least one inner load-bearing bar on which the interior wall cladding can be mounted; and at least one outer load-bearing bar on which the exterior wall cladding can be mounted. The production method of the structure system in which the main load-bearing system is used comprises the steps of: connecting the interior wall cladding to the inner load-bearing bar; connecting the exterior wall cladding to the outer load-bearing bar; and filling the filling material under pressure or vacuum, without a thermal bridge, such that the interior wall cladding connected to the inner load-bearing bar and the exterior wall cladding connected to the outer load-bearing bar are integrated. Thanks to said method, a load-bearing structure system without a thermal bridge or a modular mono-block structure is produced.

Thanks to the structure system and the production method according to the present invention, there is provided a structure which contains the main load-bearing system partially or completely, does not have a thermal bridge, helps to bear the section by strengthening it against the section forces, and can also have high insulation values. With the present invention, insulation discontinuity is eliminated. Also, with the invention, no additional insulation material is required. Thanks to the structure system, energy efficiency is provided and a design and production which is "fully unprovided with thermal bridge" can be achieved in the passive structure category. Furthermore, material and labour costs are reduced and construction period is decreased while increasing the "off-site" manufacturing capability. In addition, with the present invention, when closed-cell filling materials are used as the filling material, the main load-bearing system is protected against corrosion and rotting.

OBJECT OF THE INVENTION

An object of the present invention is to provide a structure system which enables heat, sound and moisture insulation without having a thermal bridge and has its own load-bearing elements, and a production method thereof.

Another object of the present invention is to provide a structure system which can also be constructed as a mono-block structural component, and a production method thereof.

A further object of the present invention is to provide a structure system having a high insulation capacity without having a thermal bridge, and a production method thereof.

Yet another object of the present invention is to provide a lighter and high-strength structure system with improved deflection and comfort conditions, and a production method thereof.

BRIEF DESCRIPTION OF THE DRAWINGS

Embodiments will now be described, by way of example only, with reference to the attached Figures.

DESCRIPTION OF THE INVENTION

In general, insulation of structures constructed with conventional load-bearing systems is provided by insulation materials providing heat, sound and moisture insulation and mounted externally by various methods or provided by modifying the structure of load-bearing material (especially the concrete material). While insulation materials are applied to the structures, the insulation material does not contribute to the load-bearing elements that make up the structure in terms of load-bearing, but on the contrary, it accommodates additional loads and section difficulties. Further, there may be a change in physical properties of the elements obtained by said methods, and their strength may decrease. In addition, there is an increase in the porosity, which increases the water absorption in the structures constructed with said method, and the formation of thermal bridges that cause heat transfer between two surfaces cannot be prevented. This causes heat, moisture and sound insulations to be performed additionally, thus increasing material and labour costs and causing excessive time to be spent during the construction phase. Therefore, with the present invention, there is provided a structure system which enables heat, sound and moisture insulation without having a thermal bridge and has its own load-bearing elements, and a production method thereof.

The structure system according to the present invention comprises at least one main load-bearing system preferably in the form of a bar, mesh or plate; and at least one filling material which partially or completely surrounds the main load-bearing system, preferably has an insulating feature, and is preferably mixed mechanically or chemically.

Figure 1:
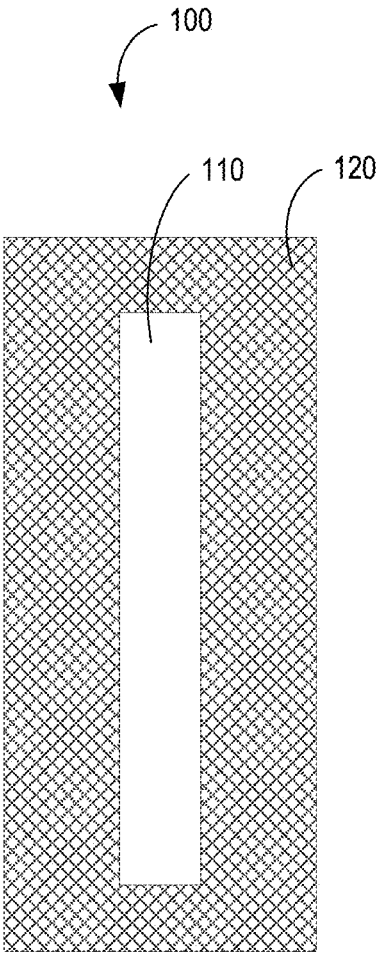
FIG. 1 shows a figurative representation of one embodiment of a structural building system.

With reference to FIG. 1, the structure system 100 according to the present invention comprises at least one main load-bearing system preferably in the form of a bar, mesh or plate 110; and at least one filling material 120 which partially or completely surrounds the main load-bearing system, preferably has an insulating feature, and is preferably mixed mechanically or chemically.

Figure 2:
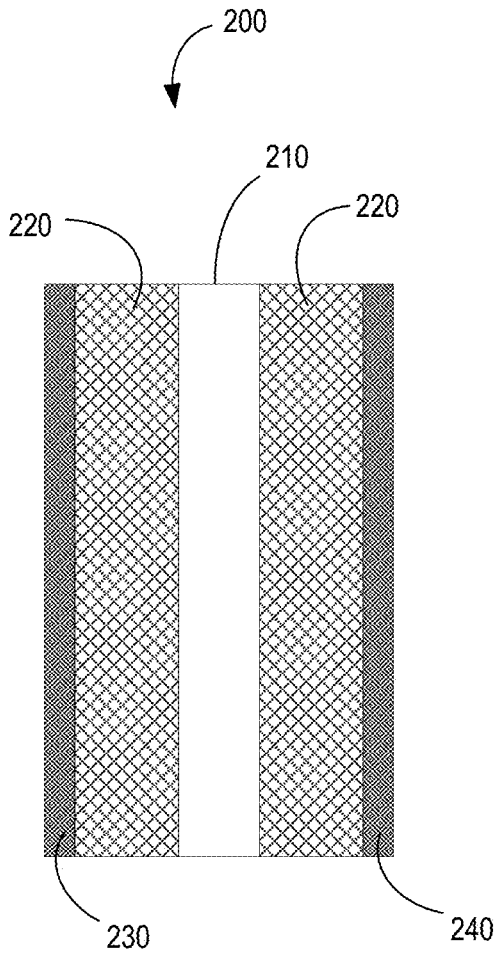
FIG. 2 shows a figurative representation of another embodiment of a structural building system.

In a preferred embodiment of the invention, and with reference to FIG. 2, the structure system 200 comprises at least one interior wall cladding 230; and at least one exterior wall cladding 240 which is positioned to have at least one space between itself and the interior wall cladding 230. In this case, the main load-bearing system 210 is preferably positioned between the interior wall cladding 230 and the exterior wall cladding 240 so as not to contact the interior wall cladding 230 and the exterior wall cladding 240.

In a preferred embodiment of the invention, the filling material 220 is preferably in the form of a foam which hardens by expanding, such as polyisocyanurate (pyr) or polyurethane (pur) foam. Therefore, thanks to the filling material, both load-bearing capacity and heat, sound and moisture insulation capability of the structure system are enhanced.

In a preferred embodiment of the invention, the structure system comprises at least one reinforcement mesh material to which the filling material is bonded. Bonding of the reinforcement mesh material with the filling material provides strength against section forces. Here, a system section without a thermal bridge can be formed, since the filling material has insulation properties.

In another preferred embodiment of the invention, the main load-bearing system is in the form of a bar and comprises at least one inner load-bearing bar on which the interior wall cladding can be mounted; and at least one outer load-bearing bar on which the exterior wall cladding can be mounted.

Figure 3:
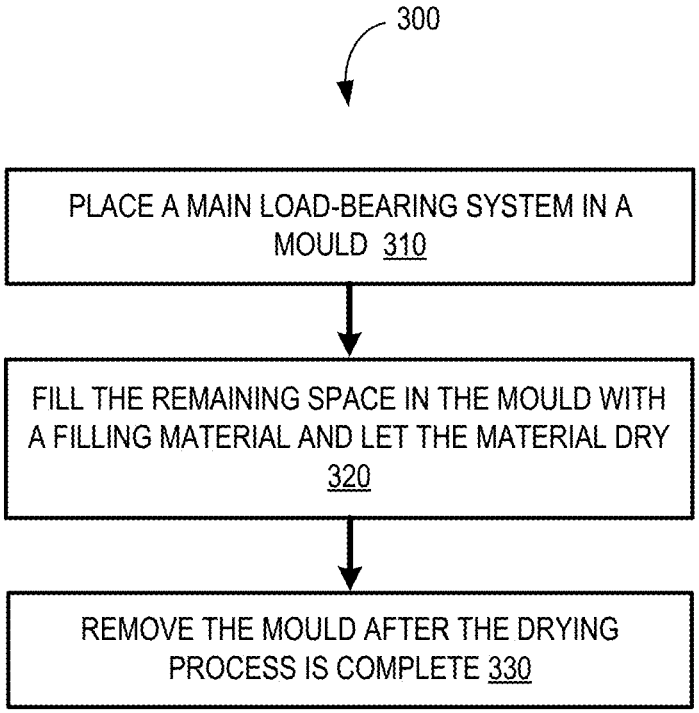
FIG. 3 shows a flowchart of one method of production for a structural building system which enables heat, sound and moisture insulation without having a thermal bridge and has its own load-bearing elements.

With reference to FIG. 3, the production method 300 of the structure system according to the present invention comprises the steps of: placing the main load-bearing system in at least one mould in such a way that it is preferably not in contact with the surfaces of the mould and there is a space between the main load-bearing system and the surfaces of the mould, wherein the filling material does not adhere to the mould and the mould limits the filling material so as to shape it 310; filling and drying the filling material in said space so as to partially or completely surround the main load-bearing system 320; and removing the mould after the drying process is completed 330. Here, after the mould is removed, the main load-bearing system and the filling material which surrounds the main load-bearing system are obtained as the final product. With said method, a mono-block modular structure is achieved. In addition, integration of the filling material by surrounding the main load-bearing system contributes to the load-bearing property and rigidity of the structure system, and at the same time, a design without a thermal bridge is allowed.

Figure 4:
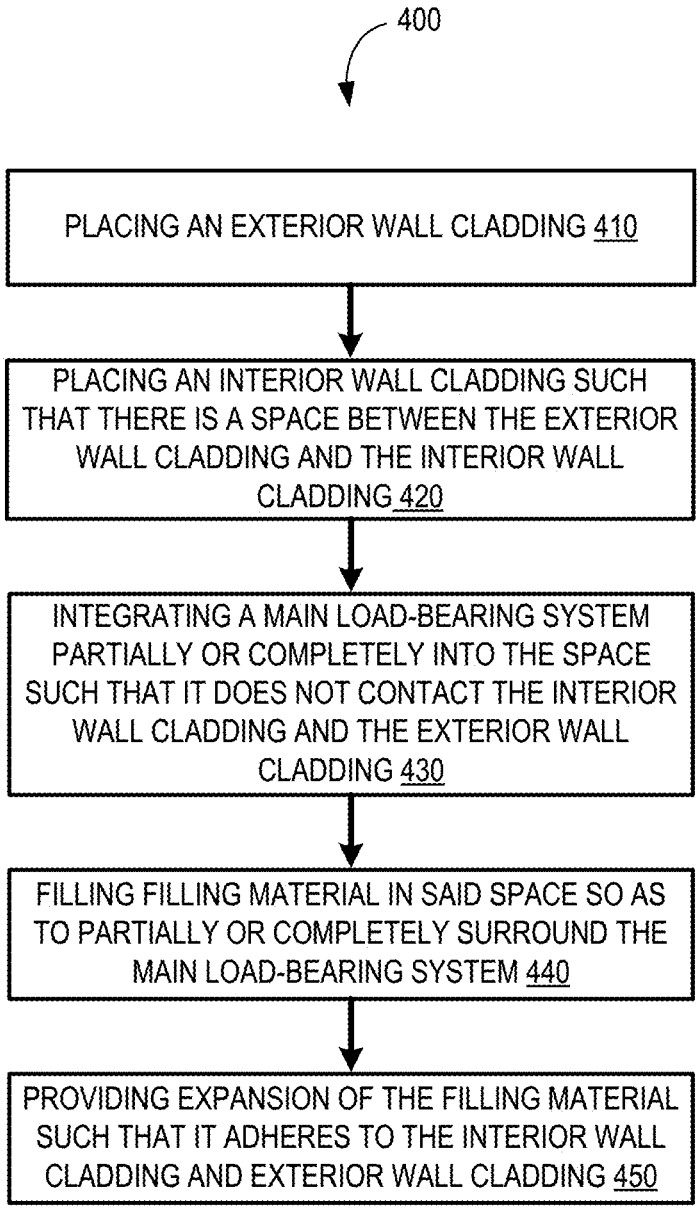
FIG. 4 shows a flowchart of another method of production for a structural building system which enables heat, sound and moisture insulation without having a thermal bridge and has its own load-bearing elements.

In another embodiment of the invention, and with reference to FIG. 4, the production method 400 of the structure system comprises the steps of: placing the exterior wall cladding 410; placing the interior wall cladding such that there is a space between the exterior wall cladding and the interior wall cladding 420; integrating the main load-bearing system partially or completely into the space such that it does not contact the interior wall cladding and the exterior wall cladding 430; filling the filling material in said space so as to partially or completely surround the main load-bearing system 440; and providing expansion of the filling material such that it adheres to the interior wall cladding and exterior wall cladding 450. The filling material expands and adheres to the exterior wall cladding and interior wall cladding with a high adherence and provides rigidity to the main load-bearing system.

In another embodiment of the invention, in the production method of the structure system, the filling material is filled into the space between the main load-bearing system and the surfaces of the mould by spraying. Similarly, the filling material is filled into the space between the interior wall cladding and the exterior wall cladding by spraying.

In another embodiment of the invention, the production method of the structure system comprises the step of combining interior wall cladding, exterior wall cladding and filling material under vacuum or by printing process.

In another embodiment of the invention, the production method of the structure system comprises the steps of: connecting the interior wall cladding to the inner load-bearing bar; connecting the exterior wall cladding to the outer load-bearing bar; and filling the filling material under pressure or vacuum, without a thermal bridge, such that the interior wall cladding connected to the inner load-bearing bar and the exterior wall cladding connected to the outer load-bearing bar are integrated. Thus, a rigid integrity without a thermal bridge is obtained between the inner and outer load-bearing elements. In addition, load-bearing and deflection comfort of the structural component produced by said method is increased. With said method, portable modular structures without thermal bridges having the capability of producing living modules and prefabricated structures can also be produced. By making use of the adherence and strength of the filling material, the main load-bearing system in the form of a bar is enabled to function as a single section against the section forces. With this method, load-bearing plate structures without thermal bridges are produced.

In another preferred embodiment of the invention, the main load-bearing system may be an interior or exterior wall cladding, a steel bar, a steel plate for which rigidity and adherence properties are enhanced by various perforation and corrugation methods, and versions thereof produced with composite materials such as carbon fibre, wood or polymer, resin-reinforced glass wool fibres, etc. Moreover, solar panels may be used as the exterior wall cladding.

In another preferred embodiment of the invention, thanks to the structure system, a force couple is formed and insulation without thermal bridges is provided by using a tensile and/or pressure resistant structural component.

In another preferred embodiment of the invention, in order to ensure dimensional stability in the structure system, temperature value of the environment in which the structure system will be used and temperature value of the environment where the structure system is produced are adjusted to be substantially the same. Therefore, there is no form/appearance defect due to the temperature difference in the structure systems whose production site and place of use are different. Moreover, even when the filling material is exposed to situations such as fire, natural disasters etc., or its contribution to the main load-bearing system is reduced, it should be sized so that it will not be subjected to total collapse even if the structure becomes unusable.

Thanks to the structure system and the production method according to the present invention, there is provided a structure which contains the main load-bearing system partially or completely, does not have a thermal bridge, helps to bear the section by strengthening it against the section forces, and can also have high insulation values. With the present invention no additional insulation material is required or the need thereof is reduced. Thanks to the structure system, energy efficiency is provided and a design and production which is "fully unprovided with thermal bridge" can be achieved in the passive structure category. Furthermore, material and labour costs are reduced and construction period is decreased while increasing the "off-site" manufacturing capability. In addition, with the present invention, when closed-cell filling materials are used as the filling material, the main load-bearing system is protected against corrosion and rotting.

The invention claimed is:

1. A production method of a structure system which enables heat, sound and moisture insulation without having a thermal bridge and has its own load-bearing elements, comprising the steps of:

placing a main load-bearing system in at least one mould in such a way that there is a first space between the main load-bearing system and surfaces of the at least one mould, wherein a filling material does not adhere to the at least one mould and the at least one mould limits the filling material so as to shape the filling material;

filling and drying the filling material in said first space so as to partially or completely surround the main load-bearing system; and removing the at least one mould after a drying process is completed;

further comprising the steps of:

placing an exterior wall cladding;

placing an interior wall cladding such that there is a second space between the exterior wall cladding and the interior wall cladding;

integrating the main load-bearing system partially or completely into the second space such that it does not contact the interior wall cladding and the exterior wall cladding;

filling the filling material in said second space so as to partially or completely surround the main load-bearing system; and providing expansion of the filling material such that it adheres to the interior wall cladding and exterior wall cladding.

2. The production method of a structure system according to claim 1, further comprising the step of filling the filling material into the first space between the main load-bearing system and the surfaces of the at least one mould by spraying.

3. The production method of a structure system according to claim 1, further comprising the step of combining interior wall cladding, exterior wall cladding or filling material under vacuum or by printing process.

4. The production method of a structure system according to claim 1, further comprising the step of connecting the interior wall cladding to an inner load-bearing bar; connecting the exterior wall cladding to an outer load-bearing bar; and filling the filling material under pressure or vacuum, without a thermal bridge, such that the interior wall cladding connected to the inner load-bearing bar and the exterior wall cladding connected to the outer load-bearing bar are integrated.

* * * * *